US005635147A

United States Patent [19]

Herbert et al.

[11] Patent Number: 5,635,147

[45] Date of Patent: Jun. 3, 1997

[54] PROCESS OF TREATING THE GASIFICATION RESIDUE FORMED BY THE GASIFICATION OF SOLID FUELS IN A FLUIDIZED BED

[75] Inventors: Peter Herbert, Frankfurt; Rainer Reimert, Idstein-Kroftel; Michael Stroder, Neu-Anspach, all of Germany

[73] Assignee: Metallgesellschaft Aktiengesellschaft, Frankfurt am Main, Germany

[21] Appl. No.: 409,254

[22] Filed: Mar. 23, 1995

[30] Foreign Application Priority Data

Mar. 26, 1994 [DE] Germany ..... 44 10 598.3

[51] Int. Cl.[6] ..... C01B 17/16; C10B 57/00

[52] U.S. Cl. ..... 423/168; 423/563; 423/566.3; 44/620; 201/17; 201/45

[58] Field of Search ..... 106/DIG. 1; 201/17, 201/45, 31; 44/591, 620; 423/165, 166, 168, 563, 566.1, 566.3; 209/162

[56] References Cited

U.S. PATENT DOCUMENTS

| | | | |
|---|---|---|---|
| 3,272,721 | 9/1966 | Loevenstein | 201/17 |
| 3,625,164 | 12/1971 | Spector | 110/1 J |
| 3,642,445 | 2/1972 | Muter et al. | 23/25 Q |
| 3,970,434 | 7/1976 | Gasior et al. | 44/1 F |
| 4,053,285 | 10/1977 | Robinson et al. | 44/1 F |
| 4,233,034 | 11/1980 | Miller et al. | 44/1 SR |
| 4,516,980 | 5/1985 | Wheelock | 44/1 SR |
| 4,961,756 | 10/1990 | Rich, Jr. | 44/605 |

FOREIGN PATENT DOCUMENTS

| | | | |
|---|---|---|---|
| 196325 | 3/1958 | Austria | 201/17 |
| 57-145183 | 9/1982 | Japan | C10L 5/00 |
| 932956 | 7/1963 | United Kingdom | 201/17 |

OTHER PUBLICATIONS

English translation of Austrian patent no. 196,325; published Aug. 1957 (inventor not indicated).

"Basic College Chemistry" By Babor, 2nd. ed., (1953) Crowell Co. New York p. 256 (no month).

"Chemical Engineers' Handbook" By Perry et al. (1973) McGraw–Hill Book Co. New York pp. 9–5 to 9–7 and 9–23. (no month).

*Primary Examiner*—Gary P. Straub
*Assistant Examiner*—Timothy C. Vanoy
*Attorney, Agent, or Firm*—Sprung Horn Kramer & Woods

[57] ABSTRACT

In addition to ash and coke, the gasification residue contains alkaline earth metal sulfide and alkaline earth metal oxide because desulfuring agents have been supplied to the gasifier. At temperatures from 5° to 80° C. the gasification residue is mixed with an acid-containing aqueous solution so that a gas which is rich in $H_2S$ is produced. Ash, coke, and alkaline earth metal salt are supplied to a flotation zone, in which coke is separated. A solid residue which contains ash and alkaline earth metal salt is withdrawn from the flotation zone. Carbonic acid or dilute sulfuric acid is preferably used as an acid.

3 Claims, 1 Drawing Sheet

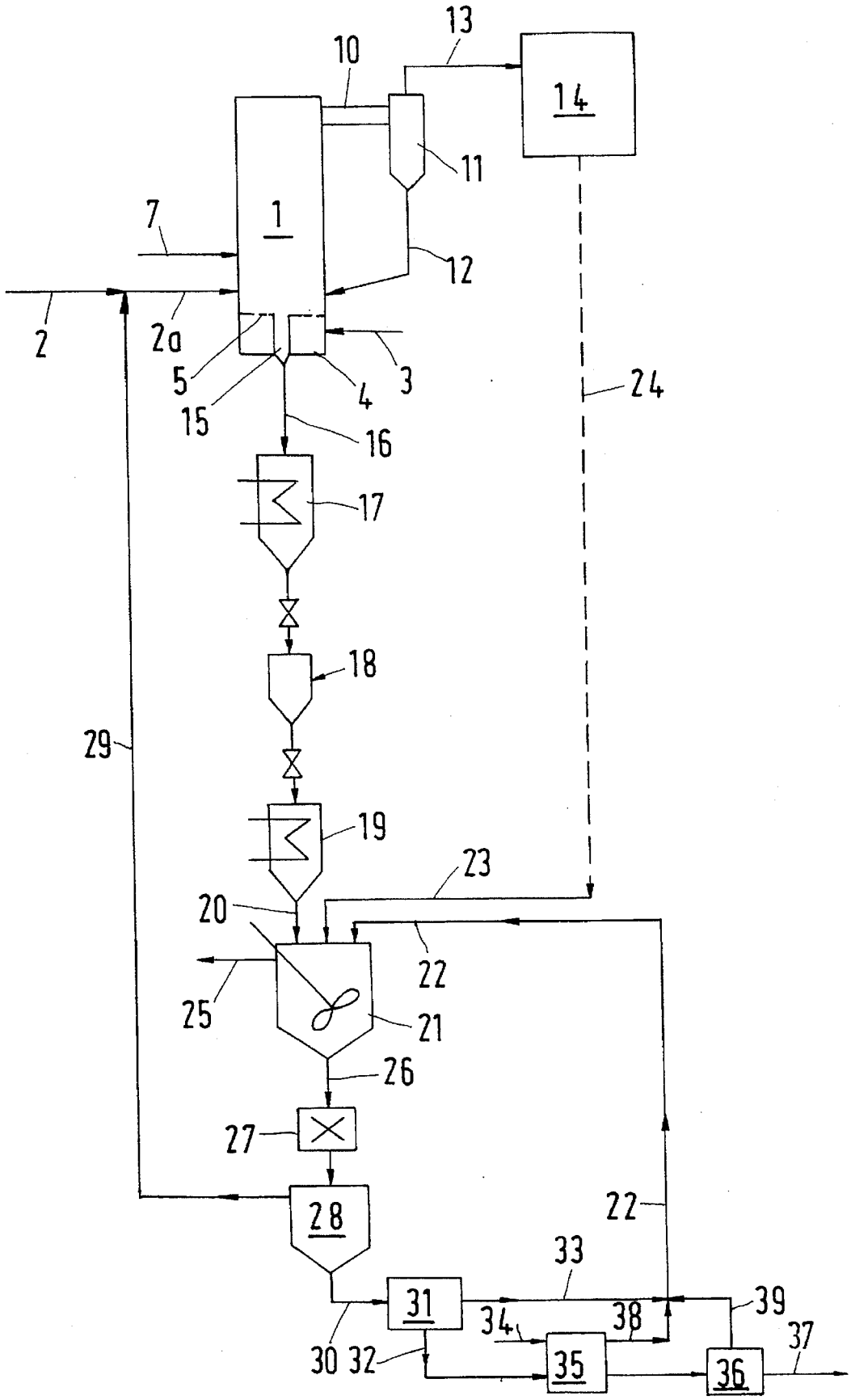
13
10
14
11
7
1
12
2
2a
5
15
4
3
24
16
17
18
29
19
23
20
22
25
21
26
27
28
22
33
31
39
34
38
37
30
32
35
36

PROCESS OF TREATING THE GASIFICATION RESIDUE FORMED BY THE GASIFICATION OF SOLID FUELS IN A FLUIDIZED BED

BACKGROUND OF THE INVENTION

This invention relates to a process of treating a gasification residue that is formed by the gasification of sulfur-containing granular fuels at temperatures from 700° to 1100° C. in a fluidized bed reactor, which in addition to the fuels and an oxygen-containing fluidizing gas is supplied with at least one alkaline earth metal carbonate or alkaline earth metal oxide for effecting an at least partial desulfurization of the product gas formed by the gasification, wherein the gasification residue withdrawn from the gasifier contains 8 to 80% by weight coke, 2 to 45% by weight alkaline earth metal sulfide, and 1 to 25% by weight alkaline earth metal oxide. The alkaline earth metals usually consist of Ca and/or Mg.

DESCRIPTION OF THE PRIOR ART

U.S. Pat. No. 3,642,445 discloses the processing of the ash from a coal-firing power plant. It is desired to separate alkaline earth metal carbonates by flotation from the fly ash and to dewater said carbonates and to re-use them outside the power plant.

It is an object of the invention to remove sulfur in the process described first hereinbefore from the gasification residue and to recover coke for the gasification in a manner which is as simple as possible so that the remaining residue is more suitable for being dumped.

SUMMARY OF THE INVENTION

This is accomplished in accordance with the invention in that the gasification residue which has been withdrawn is mixed in a mixing zone at temperatures from 5° to 80° C. with an acid-containing aqueous solution to produce a gas which is rich in $H_2S$ and is withdrawn, a gasification residue which contains ash, coke, and alkaline earth metal salt is withdrawn from the mixing zone and supplied to a flotation zone, in which coke is separated, which is supplied at least in part to the fluidized bed reactor, and a solid residue comprising ash and alkaline earth metal salt is withdrawn from the flotation zone.

The sulfur-containing granular fuels supplied to the gasifier usually consist of coal, although brown coal or peat may also be used. The gasification is performed in a fluidized bed reactor, in which a fluidization may either be effected in a stationary fluidized bed at a relatively low gas velocity or in a circulating fluidized bed at a higher gas velocity. The alkaline earth metal carbonate or alkaline earth metal oxide used for desulfurization consists in a manner known per se of a Ca and/or Mg compound, including dolomite.

By the gasification in the fluidized bed reactor, a gasification residue is formed, which in an amount which cannot be neglected may contain carbon in the form of coke. In addition to alkaline earth metal sulfide the gasification residue contains also alkaline earth metal oxide, which is formed in the fluidized bed reactor also from the $CaCO_3$ or $MgCO_3$ which has not been required for the desulfurization.

DESCRIPTION OF DRAWING

Details and variants of the invention will be explained with reference to the drawing, which is a flow sheet of the process.

DETAILED DESCRIPTION OF DRAWING

The fluidized bed reactor 1 is supplied through lines 2 and 2*a* with solid fuel, which may contain water. Oxygen-containing fluidizing gas flows in line 3 first into a distributing chamber 4 and then enters through a grate 5 the fluidized bed disposed over the grate. The chamber 4 may be supplied with oxygen in the form of air, oxygen-enriched air or commercially pure oxygen. The fluidizing gas may also contain hydrogen unless the water vapor required for the gasification is supplied as steam or water to the reactor 1 at a different location.

The content of sulfur compounds in the product gas that is formed in the reactor 1 should be minimized. To that end the gasifying fluidized bed is supplied through line 7 with alkaline earth metal carbonate or alkaline earth metal oxide, which may also contain water. The gasification in a fluidized state in the reactor 1 is effected at temperatures in the range from 700° to 1100° C. and under a pressure in the range from 1 to 100 bars. Solids-containing product gas leaves the reactor 1 through the duct 10 and coarse solids are removed from said gas in the cyclone 11. The solids are recycled to the lower part of the reactor 1 through line 12. The product gas leaves the cyclone 11 through line 13 and is treated further in the zone 14. Because combustible constituents, particularly carbon monoxide, hydrogen, and methane, are contained in the product gas, the latter may be used to generate power, e.g., in a gas turbine. This need not be discussed here more in detail.

Gasification residue is withdrawn through the duct 15 and the line 16 and is first supplied to a cooler 17. The gasification residue does not contain only ash but, as is particularly significant here, also contains 8 to 80% by weight coke and 2 to 45% by weight alkaline earth metal sulfide. The gasification residue usually also contains alkaline earth metal oxide. In the cooler 17 the temperature of the gasification residue is decreased in a manner known per se by an indirect heat exchange. The cooler may consist, e.g., of a screw cooler, a shower cooler, or a fluidized bed cooler. If the gasification residue has been under a higher pressure in the reactor 1 it will be recommendable to effect in the cooler 17 a partial cooling, to effect the required pressure relief in a pressure lock chamber 18 and to effect a further cooling in a second cooler 19. The gasification residue is usually at temperatures below 80° as it is supplied through the line 20 to a mixing vessel 21.

The vessel 21 is supplied through line 22 with water and through line 23 with an acid, such as carbonic acid ($H_2CO_3$) or $H_2SO_4$. The carbonic acid may be prepared in any desired manner but may conveniently be prepared during the treatment (in 14) and/or the utilization of the product gas and in that case may be prepared by means of $CO_2$ produced by combustion and may be supplied through line 24 represented by a broken line. In the mixing vessel 21 the carbonic acid reacts with alkaline earth metal sulfide to form $H_2S$ and alkaline earth metal carbonate and with alkaline earth metal oxide to form $H_2O$ and alkaline earth metal carbonate. If dilute sulfuric acid is used, sulfates and $H_2S$ or $H_2O$ will be formed. The acid will be used in a certain surplus to ensure that no alkaline earth metal sulfide will remain in the gasification residue because such sulfides cannot readily be dumped. Regardless of the selection of the acid, a gas which is rich in $H_2S$ is formed, which is withdrawn in line 25. The gas which is rich in $H_2S$ may be processed in a manner known per se in a Claus process plant to produce elementary sulfur.

The gasification residue withdrawn through line 26 from the mixing vessel 21 mainly contains ash, coke, and alkaline earth metal salt and is supplied through a wet-grinding mill 27 to a flotation zone 28. The wet-grinding mill 27 may be omitted if a mill, not shown, for reducing coarse particles in size is provided in line 20. In the flotation chamber 28, coke is separated because vegetable or mineral oil is added as a collecting agent to the suspension. In most cases the amount of oil is in the range from 0.1 to 1% by weight of the solids content of the gasification residue that is supplied to the flotation zone 28. It is recommended to add also a surface-active agent as a frothing agent. Air or another gas is bubbled through the flotation zone 28 to form a froth, in which the coke is enriched and which is skimmed from the surface. The coke which has thus been separated is recycled through the line 29 to the reactor 1 and will preferably be partly dewatered and/or dried before.

A suspension of ash and an alkaline earth metal salt in water flows from the flotation zone 28 through line 30 and is partly dewatered in a filter press 31. The water 33 which has been separated by the filtration is recycled through the line 22 to the mixing vessel 21. To ensure that the filtration residue 32 can readily be dumped, care must be taken that its liquid content does not contain hazardous compounds (such as $Ca(HCO_3)_2$ or $H_2SO_4$). For that purpose it is recommendable to measure the pH of the water stream 33 and so to control the acid stream in line 23 that the concentration of soluble $Ca(HCO_3)_2$ (if carbonic acid is used in the mixing vessel 21 ) or the concentration of the acid itself in the water stream 33 will be minimized. Because the liquid content of the filtration residue 32 may still contain dissolved $H_2S$, which may be outgassed on a dump and create a smell, that residue is washed with fresh water in a drum filter 35 and is partly dewatered in a further filter press 36, which may consist of a vacuum filter press. Fresh water is supplied to the drum filter 35 through the line 34. The wash water 38 and the water 39 that has been separated in the filter press 36 are recycled through line 22 to the mixing vessel 21. Because the remaining residue 37 is substantially free of carbon and elutable and outgassable compounds, it can readily be dumped.

EXAMPLE

In a plant as shown on the drawing, coal is gasified under a pressure of 25 bars and at a temperature of about 900° C. The fluidized bed reactor is supplied per kg of coal (on a water- and ash-free basis) with 0.55 kg oxygen or 2.8 kg air as gasifying agent and with 0.074 kg ground limestone for desulfurization. The coal as supplied is composed of

| | |
|---|---|
| C | 65% by weight |
| H | 5% by weight |
| O | 12% by weight |
| N | 1.5% by weight |
| S | 1.5% by weight |
| Moisture | 8% by weight |
| Ash | 7% by weight |

In case of a 80% conversion of the carbon and a desulfurization of 98%, the gasification residue withdrawn through the duct 15 will be composed of

| | |
|---|---|
| Coke | 51.9% by weight |
| Ash | 29.4% by weight |
| CaS | 13.2% by weight |
| CaO | 5.5% by weight |

A temperature of 35° prevails in the mixing zone 21, which is supplied with 1.5 liters water per kg of the gasification residue and with gaseous $CO_2$ at a $CO_2/(CaS+CaO)$ molar ratio of 1.1. By the reactions $$CaS+CO_2+H_2O \rightarrow H_2S+CaCO_3$$

and $$CaO+CO_2 \rightarrow CaCO_3$$

the CaS and CaO are completely reacted and 0.041 $sm^3$ ($sm^3$=standard cubic meter) $H_2S$ are produced per kg of gasification residue.

A suspension is supplied from the mixing zone 21 through the wet-grinding mill 27 to the flotation zone 28 and is diluted there with additional water. When 6 kg oil have been added per 1000 kg of dry residue and a gas is bubbled through, a froth is formed, which contains 50% of the solids and 82% of the carbon. As a result, the residue 32 is so low in carbon that it may be dumped without difficulty. That residue is obtained at a rate of 13 700 kg per 100 000 kg of coal to be gasified (on a dry basis).

It will be understood that the specification and examples are illustrative but not limitative of the present invention and that other embodiments within the spirit and scope of the invention will suggest themselves to those skilled in the art.

We claim:

1. A process for treating a gasification residue that is formed by the gasification of sulfur-containing granular fuel selected from the group consisting of coal, lignite and peat, said granular fuel being gasified in a fluidized bed reactor at a temperature from 700° to 1100° C. by feeding an oxygen-containing fluidizing gas into said reactor, and feeding into said reactor at least one alkaline earth metal carbonate or alkaline earth metal oxide for effecting at least a partial desulfurization of a product gas, by the gasification said product gas and said gasification residue being formed, said process comprising the steps of:

a) withdrawing at least a portion of said gasification residue from the lower part of said reactor, said withdrawn residue containing ash, 8 to 80 percent by weight coke, 2 to 45 percent by weight alkaline earth metal sulfide, and 1 to 25 percent by weight alkaline earth metal oxide, and cooling said withdrawn residue to a temperature in the range of 5° to 80° C.;

b) feeding the cooled residue from step (a) into a mixing zone and mixing it with an aqueous solution of sulfuric acid, reacting said residue with said acid and producing alkaline earth metal salt and a gas which is rich in $H_2S$, withdrawing said gas from said mixing zone;

c) from the mixing zone of step (b) withdrawing a remaining gasification residue, said remaining residue containing ash, coke and alkaline each metal salt, supplying said remaining residue into a flotation zone, feeding a gas and a vegetable oil or mineral oil into said flotation zone and forming a coke-containing froth in said flotation zone, withdrawing said coke-containing froth from said flotation zone and supplying at least a portion of said withdrawn coke into said fluidized bed reactor; and d) withdrawing from said flotation zone a suspension containing ash and alkaline earth metal, and dewatering said suspension.

2. A process according to claim 1, wherein the gasification residue withdrawn from the mixing zone is ground before it is supplied to the flotation zone.

3. A process according to claim 1, wherein the gasification residue is ground before it enters the mixing zone.

* * * * *